United States Patent [19]

Klemmer et al.

[11] Patent Number: 4,485,734

[45] Date of Patent: Dec. 4, 1984

[54] FOUR COLUMN POSITIONING MECHANISM FOR CALENDER MACHINES

[75] Inventors: Paul J. Klemmer; Michael J. Daul, both of Appleton, Wis.

[73] Assignee: Appleton Machine Company, Appleton, Wis.

[21] Appl. No.: 478,442

[22] Filed: Mar. 24, 1983

[51] Int. Cl.[3] ..... B30B 3/04

[52] U.S. Cl. ..... 100/168; 100/47; 100/163 A; 100/170

[58] Field of Search ..... 100/168, 169, 170, 47, 100/163 R, 163 A; 72/232, 234

[56] References Cited

U.S. PATENT DOCUMENTS

| | | | |
|---|---|---|---|
| 3,016,819 | 1/1962 | Kupka | 100/163 A |
| 3,115,672 | 12/1963 | Seanor | 100/168 X |
| 3,122,992 | 3/1964 | Kautz | 100/170 X |
| 3,369,483 | 2/1968 | Müller | 100/170 X |
| 3,584,570 | 6/1971 | Sass et al. | 100/163 |
| 3,777,656 | 12/1973 | Muller | 100/47 |
| 3,884,140 | 5/1975 | Christ et al. | 100/163 R |
| 3,884,141 | 5/1975 | Lehmann | 100/163 R |
| 3,948,166 | 4/1976 | Wenzel | 100/163 R |
| 4,266,475 | 5/1981 | Lamon et al. | 100/168 |

FOREIGN PATENT DOCUMENTS

| | | | |
|---|---|---|---|
| 2025480 | 1/1980 | United Kingdom | 100/170 |

*Primary Examiner*—Billy J. Wilhite
*Assistant Examiner*—Christine A. Peterson
*Attorney, Agent, or Firm*—McDougall, Hersh & Scott

[57] ABSTRACT

A positioning mechanism for four column calender machines is disclosed. The mechanism employs an interconnected piston and cylinder arrangement to permit the rolls to be quickly separated and subsequently automatically repositioned. The rolls are supported on a plate assembly movable on a vertically disposed way mounted on the columns. A lost motion arrangement is provided in the plate assembly so that when a paper break occurs or when it is otherwise desired to separate the rolls quickly, the cylinders are released permitting rapid relative movement between the rolls to prevent damage.

10 Claims, 7 Drawing Figures

FOUR COLUMN POSITIONING MECHANISM FOR CALENDER MACHINES

BACKGROUND OF THE INVENTION

The invention relates to calenders and super calenders of the type used to finish paper for printing or other applications where a relatively high smoothness is required. In such devices the paper passes between the nip of a number of rollers and by the circumferential friction of the rolls on the paper surface a polishing action is obtained. The rollers are generally arranged in a vertical stack. Iron rolls alternate with paper filled rolls, that is, rolls which are formed by placing a large number of doughnut-like paper disks on a common shaft. These paper filled rolls are largely responsible for the polishing action.

Paper filled rolls are easily damaged in the event that there is a break in the paper web being polished. When the web breaks it bunches and jams between the nips of the rollers causing unevenness on the surface of the paper filled rolls impairing the ability of such rolls to polish the web evenly.

In an effort to avoid damage to paper filled rolls when a web breaks and to permit adjustment of the spacing between rolls as they wear down, it is necessary to provide some mechanism for positioning the rolls relative to each other and for rapidly separating them in the event of a break in the paper web or similar emergency condition which could damage the rolls. Separating systems are known in the prior art and, for example, see U.S. Pat. Nos. 3,777,656, 3,948,166, and 3,584,570 which disclose lifting mechanisms. These references are discussed more fully in the Prior Art Statement submitted with this application and hereby incorporated by reference. Although lifting mechanisms are known, none of the foregoing has the capability of rapidly separating the rolls in the event of an emergency condition and the capability of automatically repositioning the rolls to their correct operative positions particularly when a worn paper roll has been replaced with a new roll of a different diameter.

U.S. Pat. No. 4,266,475, assigned to the present assignee, discloses a positioning mechanism which is capable of rapidly separating calender rolls in the event of an emergency condition and automatically repositioning the rolls to resume operation. That patent discloses a system suitable for a two column calender machine and employs a lost motion connection between the rod eye of the piston and the pin used for securing it to the flange plate of the cylinder immediately thereabove. The present invention constitutes an improvement upon the construction disclosed in the '475 patent and is suitable for applications where the device of the '475 patent could not be employed.

The present invention is a four column design in which each roll is supported for vertical movement on the four columns. Four rather than two piston and cylinder assemblies are associated with each roll and a lost motion connection is provided between a side plate and the bearing housings associated with each roll. Such construction has several advantages: larger calender machines can be built due to the added strength of the four column design; it is as quick as or quicker than the two column design in separating the rolls; it is sturdier and has more tolerance to vibration than the two column design and, significantly, most existing calender equipment employs a four column support system.

The present invention thus permits existing equipment to be retrofitted to obtain the advantages of the present invention with minimum down time. The device of the '475 patent, although suitable for new calender machines, is not easily retrofitted to existing calender machines.

It is accordingly an object of the invention to provide an improved positioning mechanism for four column calender machines which is capable of accomplishing rapid separation of the rolls in an emergency situation.

A further object of the invention is to provide a device of the type described capable of automatically repositioning the rolls in their proper operative relation regardless of changes in the roll diameter of the rolls in the calender stack.

A further object of the invention is to provide a hydraulic cylinder lifting mechanism for a four column calender machine which utilizes an improved lost motion connection to rapidly space the rolls one from the other in an emergency situation by an amount determined by the lost motion elements.

A further object of the invention is to provide a hydraulic lowering mechanism for a calender stack which can rapidly separate the rolls in the stack by a preset amount to limit damage to the rolls in the event of a paper break.

Other objects and advantages of the invention will be apparent from the remaining portion of the specification.

DETAILED DESCRIPTION

Figure 1:
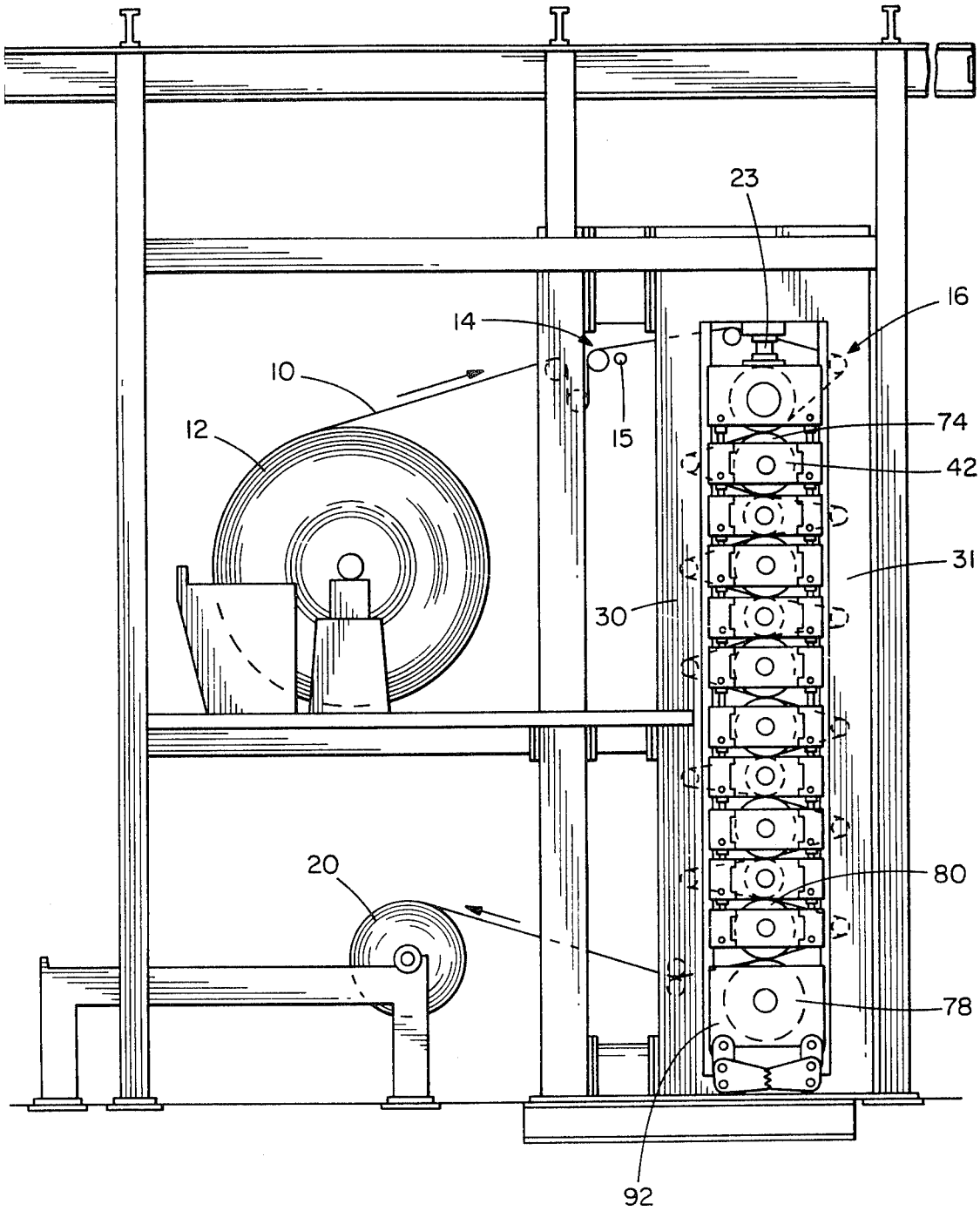
FIG. 1 is a side elevational view of a calender according to the invention.
Figure 2:
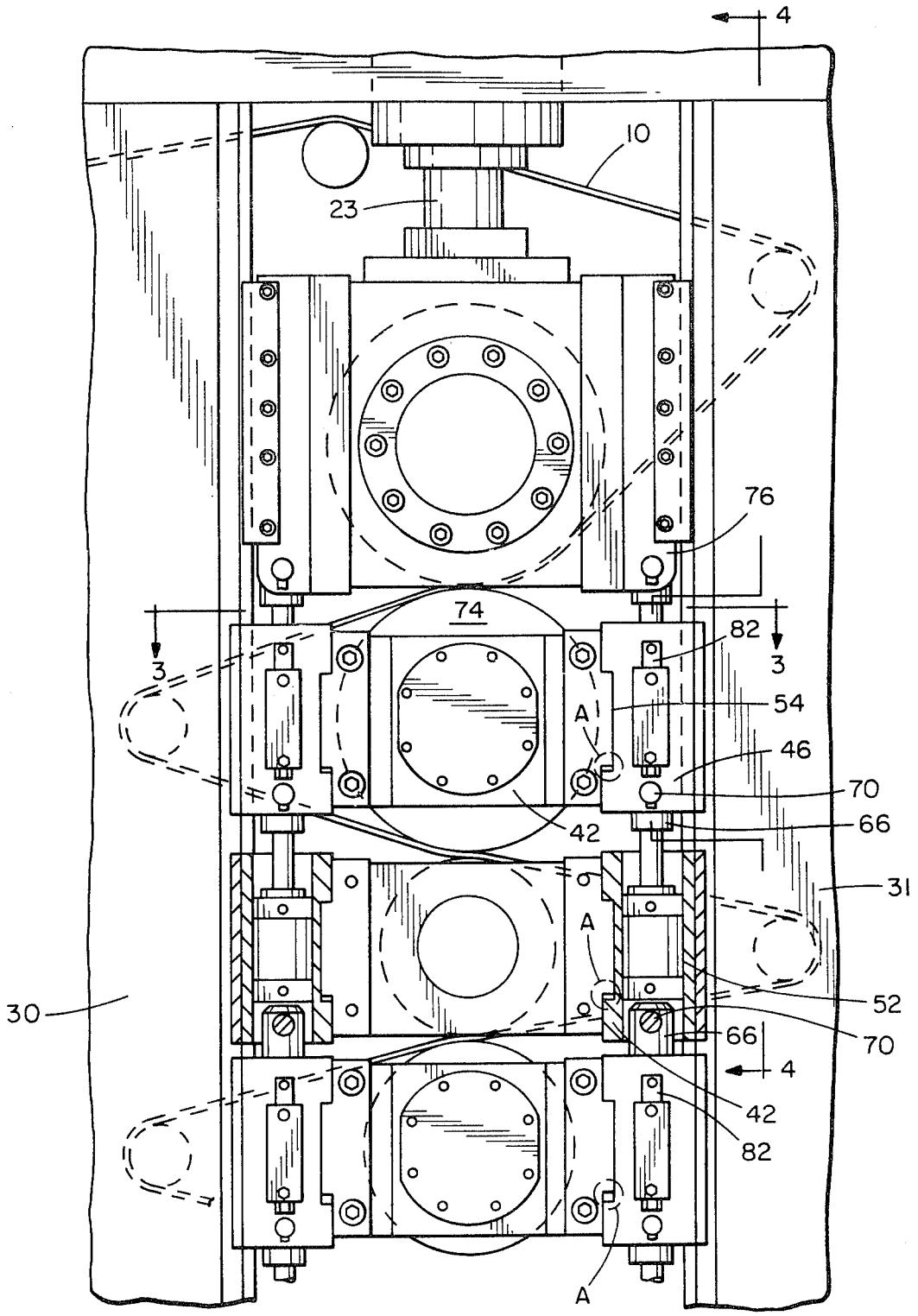
FIG. 2 is an enlarged view of the calender stack of FIG. 1 providing additional details.

Referring to FIGS. 1 and 2, a calender machine for imparting smoothness to a surface of a paper web is illustrated. The web 10 is drawn from a roll 12 and passes through tension sensing rollers 14 to a stack of calender rollers generally indicated at 16. The web 10 passes back and forth between the nips of the rollers, at least one of which is driven with the resulting friction accomplishing the polishing action in a manner well known to those skilled in the art.

The calender roll stack is formed of a combination of iron and paper filled rolls, the number and location of each type being a function of the type of paper, the smoothness desired, and similar considerations. In any case, a number of paper filled rolls would be included in the stack and are subject to uneven wear or damage in the event of a break or jam in the web 10. After passing through the nip of the bottommost pair of rollers, the web leaves the calender stacks and is wound onto a take up reel 20.

To detect web jams and breaks, various mechanisms can be employed as, for example, an electric eye 15. In the event of a break or jam, it is necessary to rapidly separate the rollers, one from the other, to avoid damaging the paper filled rolls. During normal operation the rolls are under pressure by virtue of one or more hydraulic cylinders 23 connected between the frame of the machine and the topmost roll and the bottom roll mechanism to be described. When a web break occurs, cylinders 23 must begin removing pressure from the roll stack and ultimately lift the stack. This action of the cylinders 23 is not fast enough to prevent damage to the paper filled rolls.

Simultaneously, a bottom roll is rapidly lowered allowing the intermediate rolls to separate by the distance of a lost motion connection to be described. The separation occurs quickly enough to prevent the broken paper web from wedging between the nips of the rolls and damaging them.

Figure 3:
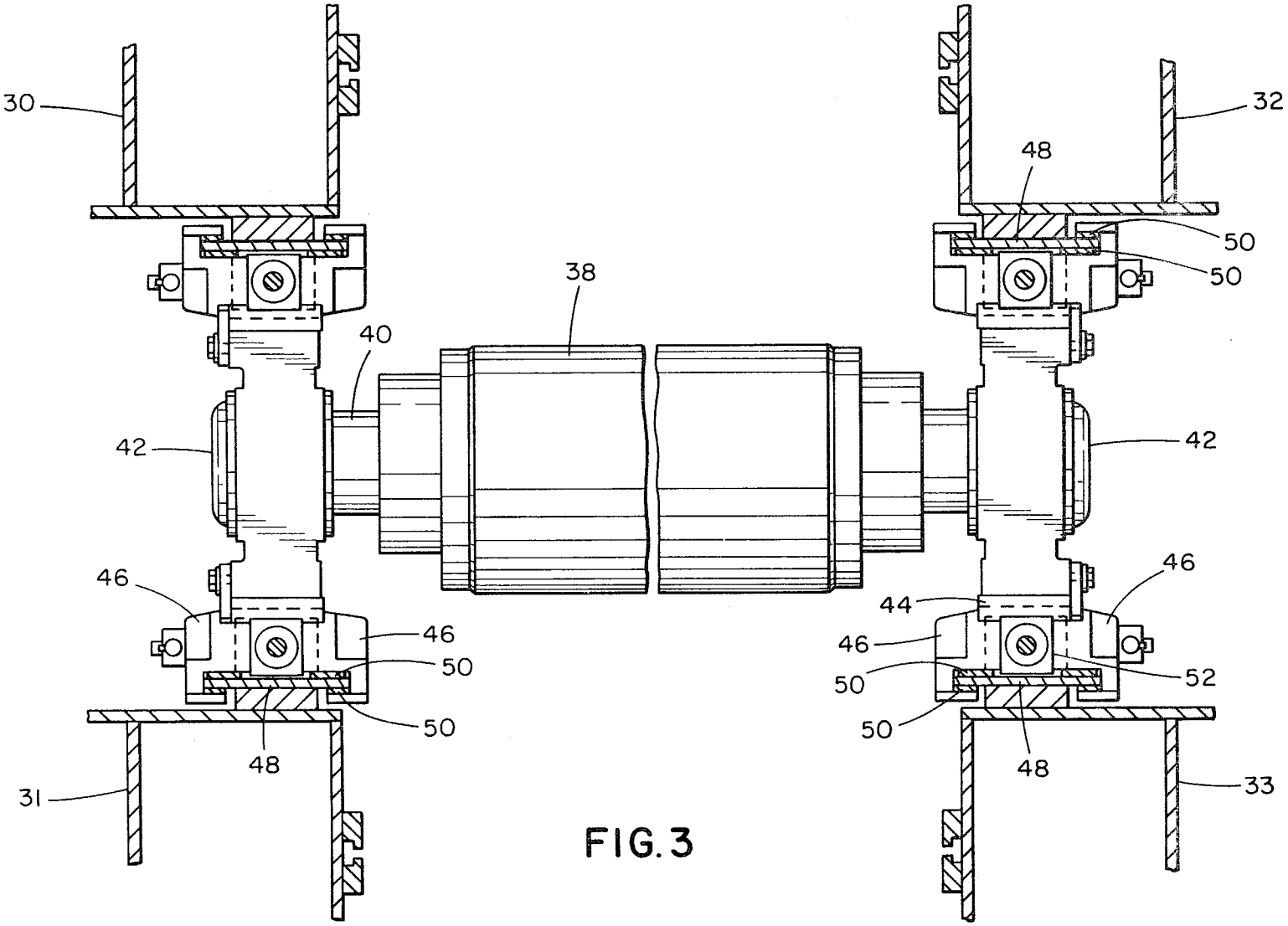
FIG. 3 is a top sectional view through the calender stack along the lines 3—3 of FIG. 2.

With particular reference to FIGS. 2 and 3, the present invention is designed for a four column calender machine. Columns 30, 31, 32 and 33 are provided to support the rolls in a vertical stack. Each such roll, with the exception of the top and bottom rolls, is supported on the columns as follows. A roll such as roll 38 in FIG. 3, which may be an iron roll or a paper filled roll, is supported for rotation on a shaft 40, the ends of which are received in bearings contained within bearing housings 42. The housings are movably secured to a plate assembly including a face plate 44 and side plates 46.

The plate assembly also includes a recessed channel dimensioned to engage a way 48 secured to each of the columns 30–33. The way is vertically positioned along the entire length of the columns thereby permitting positioning of a roll at a desired height on the columns.

Wear plates 50, secured to the plate assemblies, are provided in the channel to bear against the way 48. The face plate 44 and side plates 46 form a housing in which a cylinder assembly 52 is mounted. Four cylinder assemblies are provided for each roll and the cylinder assemblies for each roll are interconnected with the cylinder assemblies for the rolls immediately above and below as described hereafter.

A signifcant aspect of the present invention is the lost motion arrangement which exists between the bearing housings 42 and the plate assemblies, principally face plates 44. As indicated in FIG. 2 by the area contained with the circles marked "A", the bearing housing has a tab-shaped end 54 which is engaged by a reciprocally dimensioned formation in the face plate 44. The tab 54, however, is intentionally dimensioned to be smaller in the vertical direction than the spacing of the formation in the face plates whereby the bearing housing can move a small amount relative to the face plates.

Figure 5:
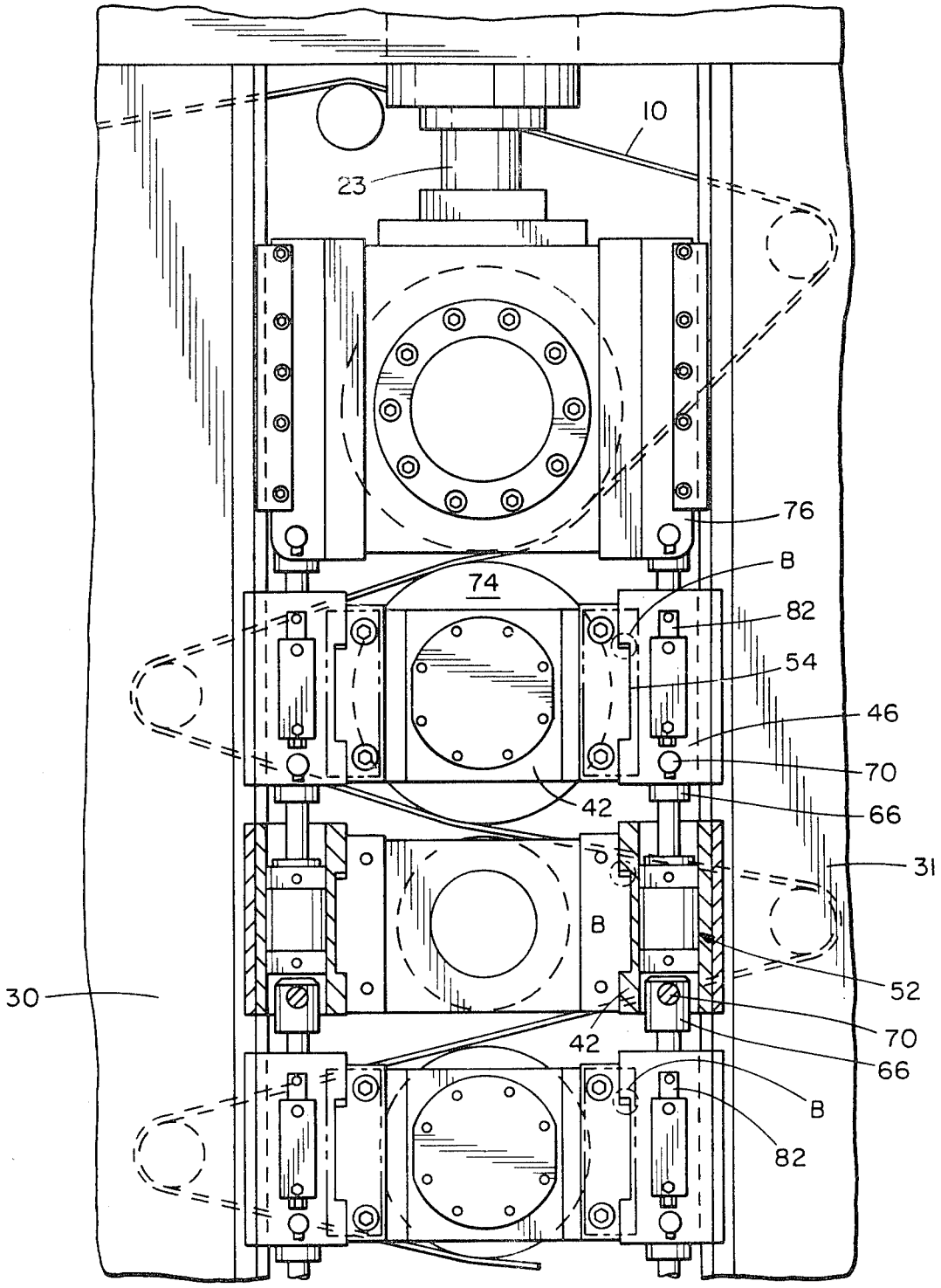
FIG. 5 is a view similar to FIG. 2 illustrating the mechanism in the position in which the rolls are spaced one from the other.

The gap thus created (A in FIG. 2) by the face plate and the bearing housing constitutes a lost motion distance which, if the bottom roll of the stack is removed from the column, is available to permit the rolls to rapidly separate, by such amount, in the manner of dropping one end of a lengh of chain links. The dimension of the lost motion spacing can be equal for each roll in the stack or can be varied as desired to compensate for the cumulative effect of the lost motion distances as the stack drops during an emergency separation. Generally, the lost motion distance will be on the order of one-eighth to one inch increasing from top to bottom. As can be seen from FIG. 5, after emergency separation, the lost motion spacing moves from the bottom of the face plates to the top as indicated at B.

Figure 4:
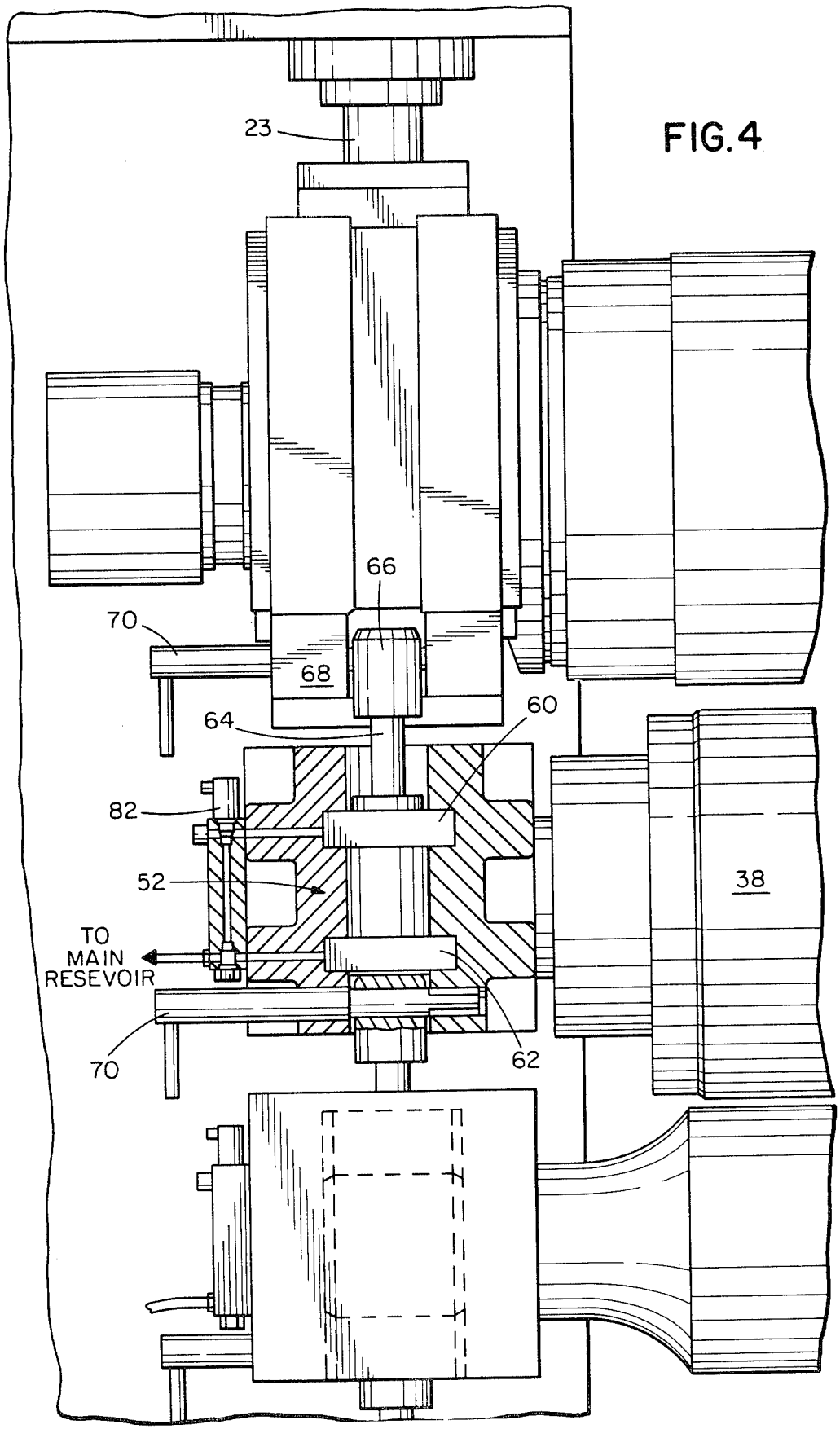
FIG. 4 is a front elevational view along the lines 4—4 of FIG. 2.

Referring now to FIG. 4, the details of the cylinder assembly and the interconnection of adjacent rolls will be described. The cylinder assembly 52 is contained within the plate assembly. Each cylinder is preferably a hydraulic, double action device commercially available. Such device includes a reservoir 60 at the rod end and a similar reservoir 62 at the cap end. Extending from the rod end of the cylinder is the piston rod 64, the end of which has a connecting knuckle 66 secured thereto. An aperture is provided through the knuckle 66 for the purpose of permitting it to be pinned to the lower portion 68 of the plate assembly of the cylinder assembly immediately thereabove.

The securing is accomplished by means of a pin 70. In this manner each of the four cylinder assemblies associated with a given roll are interconnected with the cylinder assemblies immediately above and below it in the stack. This, of course, does not apply to the bottom or top rolls in the stack which are differently mounted.

The top roll is supported by the cylinder assemblies 23 and the next roll down (74 in FIG. 2) is secured to the top roll by having its cylinders attached to mounting plates 76. Similarly, the bottom roll 78 is mounted to the lift and lower mechanism of FIGS. 6 and 7 described hereafter. The next to the lowermost roll 80 is not secured to the bottom roll. As can be appreciated, therefore, when the bottom roll 78 drops rapidly away from the rest of the stack, the stack is free to immediately drop downward, by force of gravity, to separate each roll, one from the other, by the amount of the lost motion connection distance between the bearing housing and the plate assemblies.

Returning to FIG. 4, it will be seen that each cylinder is provided with a hydraulic circuit whereby fluid from a main reservoir can be provided to the rod end or cap end reservoirs 60 and 62, respectively. A check valve 82 is provided to restrict oil flow to the direction shown by the arrow when the valve is de-energized. When the valve is energized, oil can flow in either direction equalizing pressure in the cylinder. The purpose of this construction is to lock the cylinders in position during normal operation as will be described.

Figure 6:
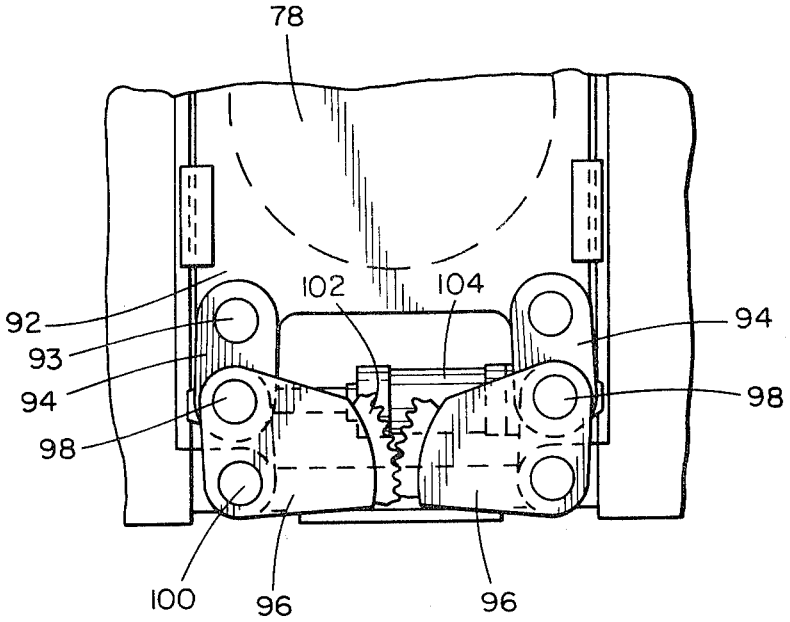
FIGS. 6 and 7 are side elevational views of the bottom portion of the calender machine illustrating the bottom roll support mechanism in its raised and lowered positions, respectively.
Figure 7:
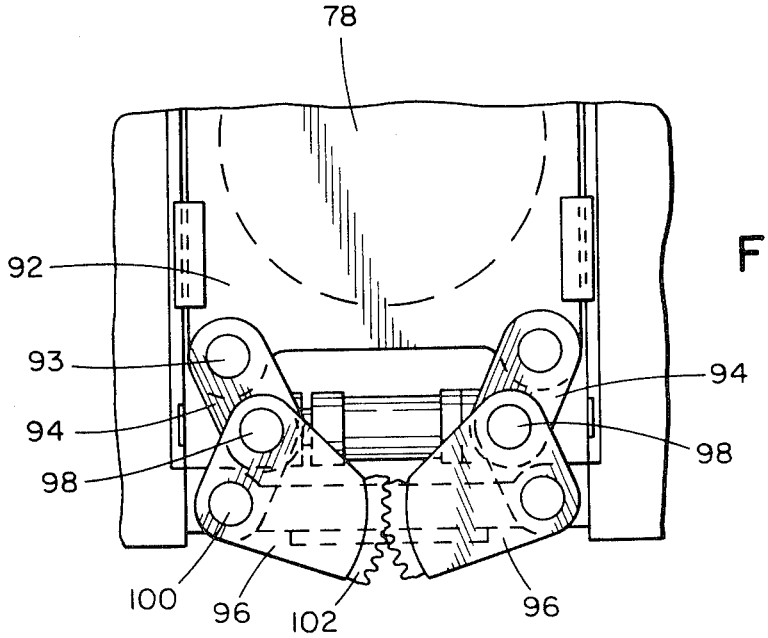

Referring now to FIGS. 1, 6 and 7, the bottom roll support mechanism is illustrated. The bottom roll 78 is supported in bearings mounted to plates 92. The lower portion of the plates are pinned at 93 to a link mechanism including a pivotable link element 94. Element 94 is, in turn, pinned to a geared link element 96 at 98 and to the frame at 100. The geared link element 96 includes a set of gear teeth 102 which mesh with the corresponding teeth as illustrated in FIG. 6.

Interconnected between the two intermediate pin elements 98 is a hydraulic piston and cylinder assembly 104. As can be readily understood by comparing FIGS. 6 and 7, when the cylinder mechanism is extended the links are essentially vertical raising the roll 78 and plate 92 to their upper position illustrated in FIG. 6. When the piston rod is retracted, the links are pivoted inwardly at the pins 98 lowering the plate 92 and the roll supported thereon.

This movement from the raised to the lowered position can be quickly accomplished. In fact, in an embodiment of the invention it has been found possible in a ten roll calender stack to separate all the nips in under 0.5 seconds from the time an electric eye detects a paper break. In spite of the quickness of the separation accomplished by the mechanism of FIGS. 6 and 7 and the related dropping due to the lost motion arrangement, the presence of the gear links 96 insures that the drop is controlled to insure even drop on all four columns.

The operation of the invention will now be described assuming that initially the calender stack is fully separated as would be the case, for example, when it is necessary to change out a paper filled roll. In that case the cylinders 23 would have fully raised the top roll and the mechanism of FIGS. 6 and 7 would have lowered the bottom roll permitting the intermediate rolls to be spaced one from the other by a maximum amount determined by the stroke length of the pistons used to interconnect the rolls. At this point the rolls are separated by much more than the lost motion connection distance since all of the pistons are fully extended. Check valve 82 is energized permitting emptying of the reservoir 60 for such purpose whereby the weight of each roll causes extension of the cylinder pistons.

To automatically reposition the rolls for calendering the bottom roll mechanism is activated raising the roll 78 to its uppermost operating position. The cylinders 23 then begin extending their pistons downwardly lowering the top roll and the rolls suspended therefrom. As the lowering continues the next to the bottom roll 80 will eventually come in contact with the bottom roll and stop moving downwardly. As it does so the piston rods associated therewith will begin retracting into the cylinder as the roll immediately thereabove continues movement until it comes in contact with roll 80. This process continues for every roll in the stack resulting, in the end, in an automatic adjustment of the calender for various roll diameters to form the necessary polishing nips. After the nips are in contact and the appropriate pressure applied thereto, cylinders 23 are each locked in their desired position.

As each roll strikes the roll below it, its bearing housings will stop moving downwardly. The associated plate assembly, however, will continue moving until the gap illustrated in FIG. 2 at A is created thereby "arming" the lost motion separating mechanism. Once the lost motion distance has been accounted for the plate assemblies also stop moving. Once the entire stack has been correctly positioned and placed under tension by the cylinders 23, the check valve 82 is de-energized preventing fluid from escaping the reservoir 60. This locks the cylinders in position preventing relative movement therebetween except for the lost motion distance since the piston rods cannot extend without displacing hydraulic fluid from the reservoir 60. At this point the calendering operations can begin on a web to be polished.

In the event of a need for an emergency separation, as in the case of a paper break, the bottom roll mechanism of FIGS. 6 and 7 is actuated to retract the piston associated with the cylinder 104 causing a pivoting of the link mechanisms and a rapid lowering of the bottom roll. When this occurs each of the rolls utilizes the lost motion distance to drop away from the roll immediately thereabove resulting in the separation illustrated in FIG. 5 with the lost motion distance now located at B. Simultaneously, but at a slower rate, it is desirable to move the top roll up so that after the lost motion separation occurs additional separation is obtained.

After correction of the emergency situation the rolls can be repositioned and calendering operations resumed.

While we have shown and described embodiments of this invention in some detail, it will be understood that this description and illustrations are offered merely by way of example, and that the invention is to be limited in scope only by the appended claims.

What is claimed is:

1. A mechanism for vertically positioning a stack of calender rolls relative to a four column support frame, each roll being mounted to the frame for movement in the vertical direction comprising:

(a) means for lifting and lowering the top roll of said stack, (b) means for lifting and lowering the bottom roll of said stack, (c) means for interconnecting the remaining rolls of said stack, one to the other and to said top roll for movement with the latter, said interconnecting means including:

(i) piston and cylinder assemblies associated with each of said remaining rolls interconnected one to the other and to said top roll, (ii) lost motion connecting means for interconnecting each piston and cylinder assembly to one of said remaining rolls, said connecting means including:

(a) means for supporting said rolls, (b) plate assemblies movable on said frame receiving and engaging said supporting means and dimensioned to permit a small vertical movement of said support means relative thereto, (d) means for controlling operation of said assemblies to permit or prevent movement of the pistons relative to the cylinders, whereby when the pistons are permitted to move the remaining rolls may be sequentially lowered and automatically positioned in contact with each other and said top and bottom rolls, and when the pistons are prevented from moving, the rolls may be rapidly separated, one from the other, by a distance determined by the lost motion connecting means simply by lowering said bottom roll.

2. The mechanism according to claim 1 wherein said supporting means include a pair of bearing housings having bearings therein on which the rolls are supported for rotation.

3. The mechanism according to claim 1 wherein each of said plate assemblies includes a face plate, said face plates configured to engage said supporting means at their upper and lower limits of lost motion travel during movement of the rolls.

4. The mechanism according to claim 1 wherein each of said columns includes a vertically aligned way, said plate assemblies having channels formed therein to receive said ways whereby movement of the roll stack on said columns is guided.

5. The mechanism according to claim 1 wherein said bottom roll lifting and lowering means includes:

(a) a pair of bottom roll support plates, (b) pivotable link means interconnecting said support plates to said frame, (c) cylinder means connected to said link means for controlling the angular movement of said links, whereby operation of said cylinder means to pivot said link means causes raising and lowering of said bottom roll.

6. The mechanism according to claim 5 wherein said link means includes link pairs having gear teeth which engage during raising and lowering of said bottom roll.

7. An interconnecting assembly for positioning calender rolls on a support frame and permitting rapid separation of the rolls comprising:

(a) a support frame, (b) a stack of calender rolls disposed one above the other, (c) means for supporting the top roll of the stack on said frame, (d) means for lifting and lowering the bottom roll of the stack, (e) means for interconnecting the remaining rolls of the stack one to the other, to the frame, and to said top roll, said interconnecting means including:

(i) means for rotatably supporting said rolls, (ii) plate assemblies movable on said frame receiving and engaging said supporting means and dimensioned to permit a small vertical movement of said support means relative thereto, whereby when the bottom roll is lowered the remaining rolls may be rapidly separated, one from the other, by virtue of the movement of the plate assemblies relative to the supporting means.

8. The mechanism according to claim 7 wherein said supporting means include a pair of bearing housings having bearings therein on which the rolls are supported for rotation.

9. The mechanism according to claim 7 wherein each of said plate assemblies includes a face plate, said face plates configured to engage said supporting means at their upper and lower limits of lost motion travel during movement of the rolls.

10. The mechanism according to claim 7 wherein said support frame includes columns having vertically aligned ways, said plate assemblies having channels formed therein to receive said ways whereby movement of the roll stack on said columns is guided.

* * * * *